United States Patent [19]

Csaszar

[11] 4,343,408

[45] Aug. 10, 1982

[54] TAMPER-EVIDENT PLASTIC CLOSURE

[75] Inventor: Ernest J. Csaszar, Mountainside, N.J.

[73] Assignee: General Kap (P.R.) Corporation, San Juan, P.R.

[21] Appl. No.: 142,429

[22] Filed: Apr. 21, 1980

[51] Int. Cl.[3] ..... B65D 49/12

[52] U.S. Cl. ..... 215/258; 215/252

[58] Field of Search ..... 215/252, 253, 258, DIG. 1, 215/329, 256

[56] References Cited

U.S. PATENT DOCUMENTS

| | | | |
|---|---|---|---|
| 3,329,295 | 7/1967 | Fields | 215/252 |
| 3,360,149 | 12/1967 | Roth | 215/DIG. 1 |
| 3,784,041 | 1/1974 | Birch | 215/256 |
| 3,955,716 | 5/1976 | Goncalves | 215/258 X |
| 4,033,472 | 7/1977 | Aichger | 215/252 |
| 4,196,818 | 4/1980 | Brownbill | 215/252 |
| 4,210,251 | 7/1980 | Grussen | 215/DIG. 1 |

*Primary Examiner*—George T. Hall

*Attorney, Agent, or Firm*—Lerner, David, Littenberg & Samuel

[57] ABSTRACT

Tamper-evident closures which are useful in conjunction with various bottles and containers are disclosed. The closures are intended to be used in connection with containers having threaded necks above an annular collar, and they comprise one-piece closures including an end wall, an internally threaded upper portion and a depending lower skirt portion which includes an inwardly projecting bead adapted to engage the annular collar on the container. The depending lower skirt portion has a substantially uniform thickness throughout its entire area intended to contact the annular collar on the container, and theclosure includes an area of weakness which is designed to fracture in a substantially horizontal plane across the closure or, in another embodiment, in a plane which neither passes through nor is tangential to the annular collar on the container. Fracture thus occurs when the closure is unthreaded from the container, thereby leaving the lower skirt portion engaged to the annular collar on the container after the end wall and internally threaded upper portion of the closure have been removed.

27 Claims, 9 Drawing Figures

TAMPER-EVIDENT PLASTIC CLOSURE

FIELD OF THE INVENTION

The present invention is directed to tamper-evident closures. More specifically, the present invention is directed to such closures which include a frangible portion which fractures when the closure is removed from the container thereby evidencing the fact that the container has been opened. Still more particularly, the present invention is directed to such closures which are useful in connection with various containers, including soda bottles and other such containers which are maintained under significant pressures.

BACKGROUND OF THE INVENTION

Both plastic and metal closures for various bottles and containers which include a tamper-evident feature have been known for many years. In most cases, this tamper-evident feature comprises a lower shoulder or skirt portion of the closure which is in some way intended to fracture or break upon removal of the closure from the container, so that it then becomes evident that the container has been opened. While a large number of these closures have been known in the past, on a commercial basis, and particularly in connection with soda bottles and other such containers maintained under significant pressures, up until quite recently metal closures have predominated. These include closures such as those shown in U.S. Pat. No. 3,812,991 which issued on May 28, 1974 to the Coca Cola Company, and many others.

The many problems encountered in connection with the use of metal closures however, have been significant. They primarily relate to the fact that in an unacceptably large proportion of cases, removal of the closure does not result in a clean and efficient fracture of the lower skirt portion, therefore making removal of the closure quite difficult and/or eliminating the tamper-evident feature completely. In addition, the cost of metal closures has recently increased dramatically, and the search for efficient plastic closures has therefore intensified.

In connection with plastic closures of this type, again a large number have been known in the past, but no commercial closure has been found which can be applied in a single step to the container or bottle, (i.e., they generally require a two-step application procedure), and can at the same time result in efficient breaking or fracturing upon its removal. One recent commercial closure which is now widely utilized is that of U.S. Pat. No. 4,033,472 to Albert Obrist AG, which issued on July 5, 1977. This closure, however, again suffers from both of these infirmities. In the first place, it requires a two-step application procedure, i.e., initial application of the closure to the bottle followed by a heating process whereby the lower depending bead 4 is deformed against the surface of the bead or collar on the bottle itself, as shown in FIG. 4 thereof. In addition, it has again been found that these closures, although used commercially, do not fracture properly in an unacceptable proportion of cases. Several other issued patents which include such two-step application procedures include U.S. Pat. No. 3,673,761 assigned to Ciba-Geigy AG, and U.S. Pat. No. 3,788,509 to Keeler, which includes a separate heating step for producing the weakened zones themselves.

Among those patents which do show a one-piece plastic closure, which does not require such a heat sealing step are those to Hamberger, namely U.S. Pat. Nos. 2,162,711 and 2,162,712. These patents, however, are directed to closures which include a weakened portion defined by corresponding grooves on the shoulder portion (see FIG. 1 thereof) of the depending skirt 23. In these closures fracture thus occurs in a vertical direction with respect to the closure, and tangentially with respect to the lugs 18 to which the skirt is attached. In addition, the skirt portion in this patent appears to be constructed so as to be thinner than the upper walls thereof. Additional such closures are also shown in the Schauer patents, namely U.S. Pat. Nos. 2,162,752 and 2,162,754. None of these patents thus teach the structure of a commercially acceptable product.

There are yet another group of patents directed to such closures which rely upon interlocking teeth or serrations in order to effect the fracture of the closure. For example, French Pat. No. 1,347,895 includes a ratchet or lug means on the breakaway skirt portion 2 thereof as well as on the bottle bead, and German Pat. No. 2,349,265 also includes lugs 16 which extend inwardly from depending skirt 13 to aid in fracturing at the point of weakness thereon. Reference in this regard is also made to U.S. Pat. Nos. 3,980,195, 3,924,769 and 4,126,240.

SUMMARY OF THE INVENTION

In accordance with the present invention, a one-piece tamper-evident closure has now been discovered which not only can be applied to containers in a one-step operation, but which also result in highly efficient fracturing of the depending lower skirt portion upon removal of the closure from a container. In particular, these tamper-evident closures comprise one-piece closure bodies including an end wall, an internally threaded upper portion, and a depending lower skirt portion. The depending lower skirt portion includes an inwardly projecting bead which is adapted to engage the annular collar portion of a container when the closure is completely threaded onto the container, and the depending lower skirt portion has a substantially uniform thickness throughout its entire area intended to engage that annular collar. These closures further include an area of weakness located above the depending lower skirt portion and designed to fracture in a substantially horizontal plane across the closure itself when the closure is unthreaded from the container, thereby leaving the depending lower skirt portion engaged to the annular collar of the container after the upper portion of the closure has been removed from that container.

In another embodiment of this closure, however, the depending lower skirt portion includes an outwardly extending shoulder portion having a substantially L-shaped outer surface, and the closure includes an area of weakness designed to fracture in a plane which does not pass through and is not tangential to the annular collar portion of the container when the closure is unthreaded therefrom.

In yet another embodiment of this closure, however, the depending lower skirt portion includes an inwardly projecting bead adapted to engage the lower end of the annular collar portion of the container when the closure is completely threaded onto the container, and the closure includes an area of weakness located above the inwardly projecting bead, and the entire portion of the depending lower skirt portion of the closure located below the area of weakness has a substantially uniform thickness.

In a preferred embodiment of the closures of the present invention, the area of weakness is formed by a circumferential groove formed on the outer surface of the closure, preferably a V-shaped groove, which can include a slot or a plurality of slots whereby at least a portion of the groove passes entirely through the closure, in effect forming a pre-cut area of weakness.

In another preferred embodiment of the present invention, the inwardly projecting bead at the end of the depending lower skirt portion includes a gradually tapered lower surface to assist in effecting the gradual outward bending of the skirt when the closure is initially threaded onto the container without fracturing the closure at the area of weakness, and a substantially planar upper portion for engagement with the annular collar portion of the container when the closure is completely threaded onto the container, so that the skirt portion cannot gradually bend outward when the closure is unthreaded from the container thereby causing fracture to occur at the area of weakness.

In yet another embodiment of the present invention, the outer surface of the internally threaded upper portion of the closure includes a plurality of vertical serrations, which preferably terminate a predetermined distance above the area of weakness discussed above.

In a preferred embodiment of the present invention, the closure includes sealing means located on the inner face of the end wall so as to form a seal between the closure and the container when the closure is completely threaded onto the container. In one embodiment, the sealing means comprises a yieldable sealing disc maintained against the inner face of the end wall. In another such embodiment, however, the sealing means comprises a ridge or ridges projecting from the inner face of the end wall at a location corresponding to the position where the neck portion of the container is intended to contact the end wall when the closure is completely threaded onto the container. Preferably these ridge means thus comprise a number of concentric annular projections or ridges, and preferably three such ridges, which most preferably have a substantially V-shaped configuration.

In another embodiment of the sealing means of the present invention, the end wall of the closure includes an annular sealing membrane corresponding with the intended location of the neck portion of the container and having a thickness substantially less than that of the remainder of the end wall so that the sealing membrane is substantially more flexible than the remainder of the end wall, and can therefore conform to the shape of the neck portion of the container when the closure is completely threaded onto the container. Preferably, hinge means are located on the inner and outer annular surfaces of the sealing membrane in order to increase the flexibility of the membrane, and these hinge means will preferably be annular V-shaped grooves located on the inner face of the end wall at the inner and outer annular surfaces of the sealing membrane.

In another embodiment of the sealing means of the present invention, an annular sealing ring is provided projecting from the inner face of the end wall at a location directly adjacent to the intended location of the inner surface of the neck portion of the container upon closure, and preferably including an outwardly projecting annular bead for engagement with the inner surface of the neck portion of the container.

BRIEF DESCRIPTION OF THE DRAWINGS

The tamper-evident closure of the present invention can be further understood with reference to the drawings herein wherein.

DETAILED DESCRIPTION

Figure 3:
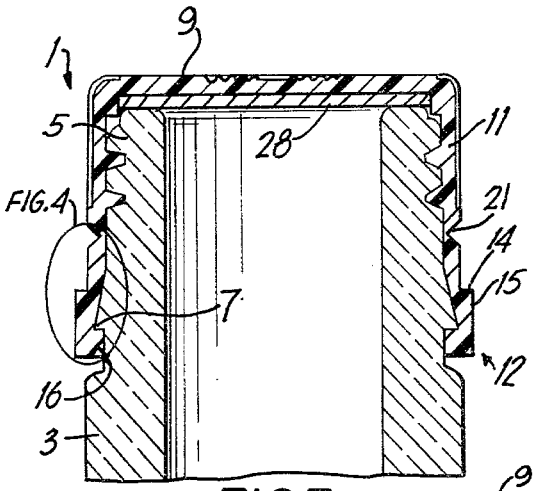
FIG. 3 is a side, elevational, cross-sectional view of a tamper-evident closure of the present invention completely threaed onto a container.
Figure 7:
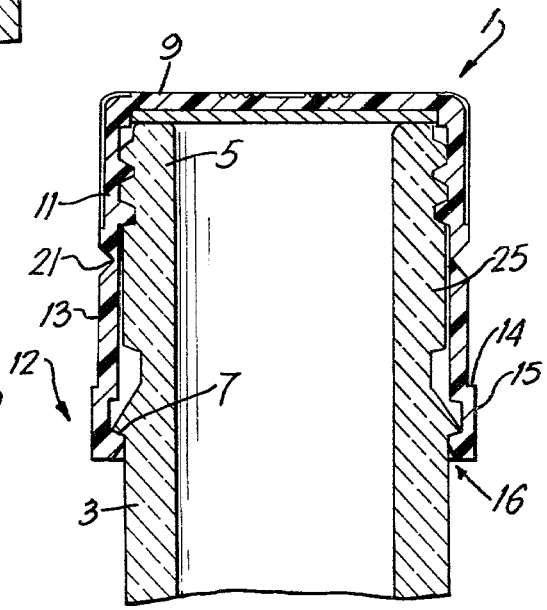
FIG. 7 is a side, elevational, cross-sectional view of another tamper-evident closure of the present invention completely threaded onto a container.

Referring to the figures, in which like numerals refer to like portions thereof, FIG. 3 shows a tamper-evident closure 1 in accordance with this invention, preferably made of a thermoplastic material, completely threaded onto a bottle or container 3. The bottle itself includes a threaded neck portion 5 and an annular collar 7 therebelow. This annular collar 7 may in some cases be referred to as a transfer bead, since in the past it has been formed in connection with the manufacture of certain types of bottles (generally glass bottles) in order to assist in the transfer or movement of the bottle during its formation. On the other hand, annular collar 7 may also be referred to as a more pronounced elongated raised surface 25 of the container, such as is shown in FIG. 7. It is this collar 7 to which the present tamper-evident closure will be firmly engaged or affixed both before and after fracture of the tamper-evident portion of the closure, and furthermore which will assist in the fracturing process itself.

Figure 1:
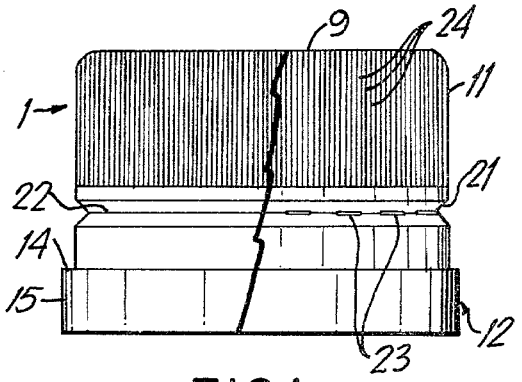
FIG. 1 is a side, elevational view of two embodiments of a tamper-evident closure of the present invention.
Figure 2:
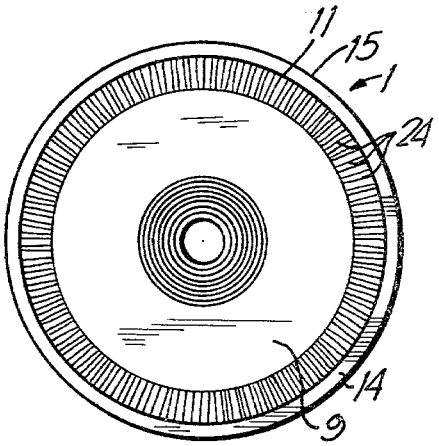
FIG. 2 is a top elevational view of the tamper-evident device of FIG. 1.

The closure 1 includes an upper end wall 9, and an internally threaded upper portion 11, which of course corresponds to the threaded neck portion 5 of the container to which is to be applied. The portion of closure 1 which is affixed to the collar of bead 7 when the closure is completely threaded onto the container 3 includes a depending lower skirt portion 12. As shown in FIGS. 1 and 3, this depending lower skirt portion 12 has a substantially L-shaped outer surface, including an upper horizontal shoulder surface 14 and a depending side wall surface 15. The inner surface of this depending side wall surface 15 includes an annular bead 16, which can best be seen in FIG. 4, and which itself includes an upper surface 18 and a lower surface 19. The lower surface 19 of bead 16 has a gradual inclined or tapered surface, so that as the closure is threaded onto the container and the surface 19 comes in contact with the upper surface of bead 7 on container 3, the entire skirt portion 12 is gradually forced outward until it snaps over bead 16, and the closure is thus completely threaded onto the container into the configuration shown in FIG. 3. On the other hand, however, when one attempts to remove closure 1 from the container 3, the substantially planar or horizontal upper surface 18 of bead 16, which is firmly engaged with the corresponding lower surface of collar 7 of container 3 now prevents any such gradual outward motion of skirt portion 12, causing an efficient fracture of the closure 1 as is more fully discussed below.

As can be seen in FIGS. 1 and 3 through 8, an area of weakness is located above the annular bead portion 16 of the depending lower skirt portion 12. In particular, as shown in FIGS. 1 and 3 through 8, a groove 21 is located on the outer surface of closure 1. The depth of groove 21 should be such that a distance X (see FIG. 4) is established between the bottom of groove 21 and the inner wall of the closure 1, with X generally being from about 0.003 inches to 0.005 inches, and preferably from about 0.002 inches to about 0.003 inches, and most preferably less than about 0.002 inches. It is also possible, however, and in many applications preferred, for at least a portion or several intermittent portions 23 of groove 21 to pass completely through the wall of closure 1 as also shown in the partial view in FIG. 1, so long as enough of a connection still remains between the internally threaded upper portion 11 and the depending lower skirt portion 12 of closure 1 so that the closure can be applied to the container without causing premature fracture to occur at this time.

Referring again to FIGS. 1 and 4 through 8, groove 21 is formed in the outer wall of closure 1 in a manner such that when fracture occurs it will occur in a horizontal plane across the closure 1, i.e., generally along line 22 formed at the bottom of the generally V-shaped groove 21. Furthermore, fracture will thus occur at a location above lower depending skirt portion 12 such that the entire lower depending skirt portion 12 will then remain (after fracture) affixed to or engaged with container 3, even after internally threaded upper portion 11 is completely removed from the container. As can thus be seen, no part of the depending lower skirt portion 12 includes any weakened area therein, and in fact fracture does not occur in proximity to bead 7 on container 3. More particularly, fracture does not occur either in a plane which passes through bead 7 or in a plane which is tangential to bead 7. On the other hand, where the annular collar 7 to which the annular bead 16 is intended to be affixed comprises the elongated raised surface 25 shown in FIG. 5, the entire portion of the lower skirt portion of the closure which is located below the area of weakness will have a substantially uniform thickness (preferably the same thickness as that of the rest of the closure). It has been found that in this manner the improved results of the present invention can be obtained, and a one-piece closure which results in a clean and efficient fracture of the weakened area upon attempting to remove the closure, results therefrom. This result is unlike any of the results which can be obtained in accordance with any such devices in the prior art.

Referring again to FIG. 1, the outer surface of closure 1 can be seen, and it includes groove 21 located between internally threaded upper portion 11 and the lower depending skirt portion 12 thereof. As can also be seen in FIG. 1, the outer surface of internally threaded upper portion 11 also includes an area which contains a plurality of vertical serrations 24 forming a linear-roughened surface thereon. This surface has been found to be not only aesthetically appealing, but it also aids in assisting one to grip the closure and twisting it in order to effect fracture and remove the internally threaded upper portion 11 therefrom.

As noted above, the closure 1 of the present invention is preferably made of a thermoplastic material, and can be manufactured in an injection molding process. Thus, the internal threads of the closure 1 can be formed by the action of an unscrewing mold. That is, after the part has been formed, during opening of the mold, the cores of the mold rotate and unscrew from the closure, thus forming the threads. The closure itself is kept from turning during this unscrewing phase by means of steel teeth, which engage the bottom of the closure and hold it in place as the core rotates.

After the unscrewing cycle is completed, a stripper plate, which is part of the mold itself, ejects the finished closure form the mold. As the mold initally opens, and before the unscrewing cycle occurs, the closure is released from an undercut position in the mold by means of angle pins which cause cam bars to separate from around the closure. This undercut position was created because protruding portions of the mold (cams) were required in order to mold the annular groove, i.e., the weak portion of the closure which is intended to fracture.

Figure 4:
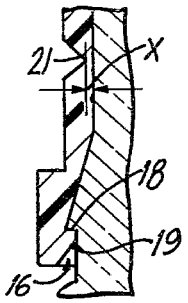
FIG. 4 is a side elevational, cross-sectional view of the circled portion of FIG. 3.

The relationship of the internal diameter of this protruding groove in the cams to the outside diameter of the mold core determines the dimension "X" shown in FIG. 4 at the point of the groove. Thus, it is possible to change that dimension in the closure by merely replacing these cam sections.

The remainder of the molding process is the same as in conventional thermoplastic molding processes.

The closure of the present invention can also be adapted to be used with a variety of containers and bottles, i.e. where for example the annular collar or bead on the bottle has different dimensions from that shown in FIG. 3, or is located at different positions relative to the end of the neck 5 of the bottle, as is shown in the embodiments of FIGS. 1 through 8. Reference is specifically made to the embodiments of FIGS. 5*a* and 6, which relate to other containers which, in the case of FIG. 5*a* includes a different neck finish and transfer head configuration, and in the case of FIG. 6 not only includes bead 7, but which also includes an elongated raised surface 25, which is sometimes found in connection with certain containers, including certain wine bottles, etc. This elongated raised surface 25, which can have a width up to about one-half inch or so, is located between threaded neck portion 5 and bead 7, and is of a height which projects above the surface of the bottle less than that of bead 7, in the embodiment shown in FIG. 7. In this embodiment, it is merely required that the overall length of the closure be extended so that the lower depending skirt portion 12 now include an added portion 13. However, it is also possible that the closures of the present invention can be adapted to a container which is similar to that of FIG. 7, but which does not include bead 7. In that case the annular bead portion of the lower depending skirt portion 12 would be adapted to engage the lower end of elongated raised surface 25 itself. In this case, it would be essential that the entire lower depending skirt portion located below groove 21 have a substantially uniform thickness, compared for example to the tapered surface of the band 5 of U.S. Pat. No. 4,033,472, in order to attain the improved results of this invention. In that event, if the elongated raised surface 25 did not extend outwardly beyond the height of the threads 5 on the container itself, it might be necessary to soften and bend the lower end of skirt portion 12 to some degree after application of the closure to the container, but this would not be necessary if the elongated raised surface 25 were raised to a sufficient extent.

Figure 8:
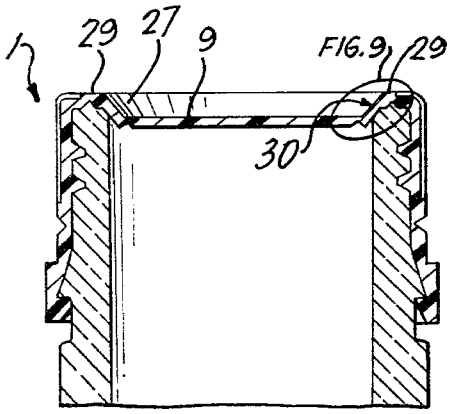
FIG. 8 is a side, elevational, cross-sectional view of another tamper-evident closure of the present invention completely threaded onto a container.
Figure 9:
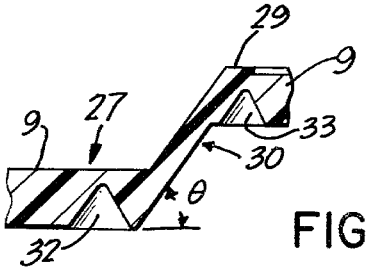
FIG. 9 is an exploded, cross-sectional view of the circled section of the tamper-evident closure of FIG. 8.

Referring to FIGS. 3, 5, 6 and 8, a number of embodiments of the closure 1 which include various sealing means are shown. Thus, in FIG. 3, a yieldable sealing disc 28, made of a material such as cork or other commercial lining materials, which will yield to a degree to absorb the pressure of the upper end of neck portion 5 when the closure 1 is completely threaded onto the container, is maintained against the inner face of end wall 9, such as by means of glue, etc. In FIG. 8, on the other hand, end wall 9 includes a circular central recessed portion 27 and an annular outer elevated portion 29. These portions are connected by means of an annular sealing membrane 30 which connects the recessed portion 27 and the elevated portion 29, and is interposed therebetween at an angle $\theta$ (see FIG. 9) of between about 25 and 45 degrees. Sealing membrane 30 comprises the same plastic material from which the entire closure is manufactured, except that whereas the remainder of the end wall 9, i.e., both the recessed portion 27 and the elevated portion 29 generally have a thickness of between about 0.040 inches and 0.060 inches, membrane portion 30 is much thinner, and will generally have a thickness of between about 0.015 inches and 0.025 inches and preferably between about 0.010 inches and 0.015 inches, such as less than about 0.025 inches. In this manner, sealing membrane portion 30 has increased flexibility so that upon threading of closure 1 onto the container, 3, the upper end wall of the neck portion of the container is pressed into contact with membrane portion 30 of end wall 9, and the membrane becomes deformed thereagainst. This produces a seal between the interior of the container and the inner wall of the internally threaded upper portion 11 of the closure 1. In addition, hinges comprising V-shaped, annular grooves 32 and 33 on the inner and outer surfaces of annular membrane portion 30 are also provided in order to further increase the flexibility of the membrane portion 30.

Figure 5:
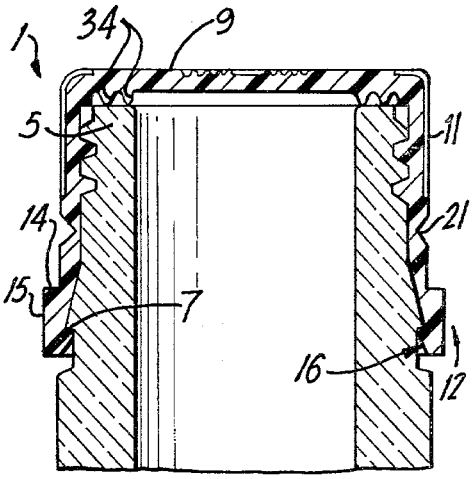
FIG. 5 is a side elevational, cross-sectional view of another tamper-evident closure of the present invention completely threaded onto a container.
Figure 5A:
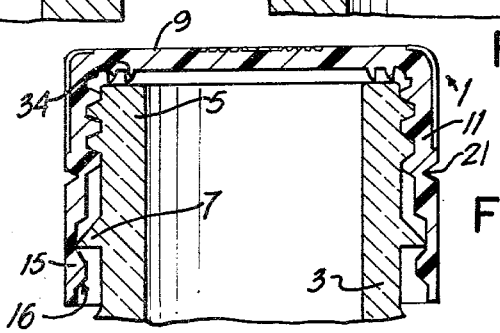
FIG. 5*a* is a side, elevational, cross-sectional view of another tamper-evident closure of the present invention completely threaded onto a container.

Referring next to FIGS. 5 and 5*a*, in these cases 4 the inner surface of end wall 9 includes one or more closely spaced annular ridges 34, preferably two or three such ridges, which project downwardly therefrom. These ridges, 34, which are preferably V-shaped in configuration, are located at the precise location where the upper end of the neck portion 5 of container 3 is intended to come into contact with the inner face of end wall 9 when the closure is completely threaded onto the container. In this manner, a seal is once again formed between the inner surface of the container and the inner surface of the internally threaded upper portion 11 of closure 1.

Figure 6:
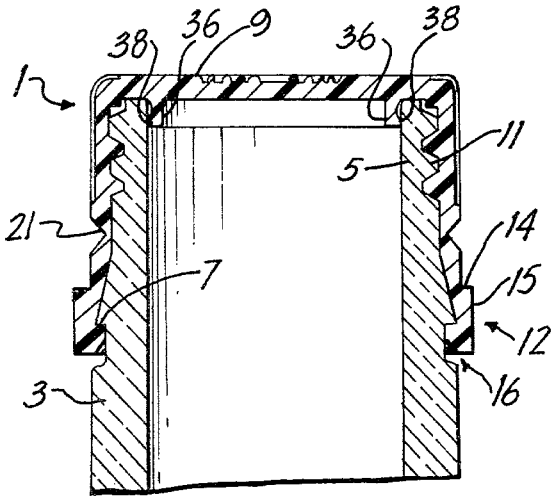
FIG. 6 is a side, elevational, cross-sectional view of another tamper-evident closure of the present invention completely threaded onto a container.

Finally, reference is made to FIG. 6, in which yet another type of seal is shown. In this case, a seal such as that which is shown in U.S. Pat. No. 4,033,472 to Obrist. This seal includes an inner annular sealing rail 36, which again projects from the inner face of end wall 9. In this case, however, the seal is intended to be located within the upper end of the neck portion of the container when the closure is completely threaded onto the container. Projecting outwardly from annular sealing rail 36 is an annular bead portion 38, so as to ensure firm contact between the bead 38 and the inner wall of the container 3.

What is claimed is:

1. A tamper-evident closure for use in connection with a container including a threaded neck portion and an annular collar portion below said threaded neck portion, said closure comprising a one-piece closure body including an end wall and a cylindrical side wall, said cylindrical side wall including an internallythreaded upper portion, a depending lower skirt portion, and an intermediate side wall portion therebetween, said depending lower skirt portion including an inwardly projecting bead adapted to engage the lower end of said annular collar portion of said container when said closure is completely threaded onto said container, said cylindrical side wall including a frangible portion comprising a circumferential groove formed on the outer surface of said closure to thereby uniformly substantially reduce the thickness of said intermediate side wall portion of said closure at a predetermined location on said intermediate side wall, said predetermined location being located above said inwardly projecting bead so as to divide said intermediate side wall portion into a first intermediate side wall portion located above said predetermined location and a second intermediate side wall portion located below said predetermined location, said first and second intermediate side wall portions being in substantial alignment with each other in the plane of said cylindrical side wall, said frangible portion therefore having a substantially uniform thickness circumferentially around said closure, and being designed to fracture in a substantially horizontal plane across said closure when said closure is unthreaded from said container so as to leave said depending lower skirt portion and said second intermediate side wall portion engaged to said annular collar portion after said internally threaded upper portion and said first intermediate side wall portion of said closure have been unthreaded from said container.

2. A tamper-evident closure for use in connection with a container including a threaded neck portion and an annular collar portion below said threaded neck portion, said threaded neck portion including threads having a maximum thread diameter, said closure comprising a one-piece closure body including an end wall and a cylindrical side wall, said cylindrical side wall including an internally-threaded upper portion, a depending lower skirt portion, and an intermediate side wall portion therebetween, said internallythreaded upper portion having threads which project inwardly from the inner surface of said cylindrical side wall, said depending lower skirt portion including an inwardly projecting bead adapted to engage said annular collar portion of said container when said closure is completely threaded onto said container, said inwardly projecting bead projecting inwardly to a point substantially no further than a plane corresponding to said inner surface of said cylindrical side wall so that said closure can be applied to said container substantially without interference from said maximum thread diameter of said threaded neck portion of said container so that said closure can be applied to said container without breaking prematurely, said cylindrical side wall including a frangible portion comprising an area of weakness designed to fracture in a substantially horizontal plane across said closure at a predetermined location on said intermediate side wall portion when said closure is unthreaded from said container, said predetermined location dividing said intermediate side wall portion into a first intermediate side wall portion located above said predetermined location and a second intermediate side wall portion located below said predetermined location, said first and second intermediate side wall portions being in substantial alignment with each other in the vertical plane of said cylindrical side wall, thereby leaving said depending lower skirt portion and said second intermediate side wall portion engaged to said annular collar portion after said internally threaded upper portion and said first intermediate side wall portion of said closure have been unthreaded from said container.

3. The tamper-evident closure of claim 1 wherein said first and second intermediate side wall portions have substantially identical cross-sectional thickness.

4. The tamper-evident closure of claim 2 wherein said first and second intermediate side wall portions have substantially identical cross-sectional thicknesses.

5. The tamper-evident closure of claim 3 or 4 wherein said internally threaded upper portion and said depending lower skirt portion of said cylindrical side wall have a cross-sectional thickness substantially identical to the cross sectional thickness of said first and second intermediate side wall portions.

6. The tamper-evident closure of claim 2, wherein said area of weakness comprises a circumferential groove formed on the outer surface of said closure to thereby uniformly substantially reduce the thickness of said intermediate side wall and create a frangible portion having a substantially uniform thickness circumferentially around said closure.

7. The tamper-evident closure of claims 1 or 6, wherein said circumferential groove includes a slot comprising at least a portion of said groove passing entirely through said closure, whereby said frangible portion has said substantially uniform thickness circumferentially around said closure except at said slot.

8. The tamper-evident closure of claim 7 including a plurality of said slots spaced around the periphery of said circumferential groove, whereby said frangible portion has said substantially uniform thickness circumferentially around said closure except at said plurality of slots.

9. The tamper-evident closure at claim 1 or 2, wherein said inwardly projecting bead includes a gradually tapered lower surface for assisting in the gradual outward bending of said depending lower skirt portion upon threading said closure completely onto said container without fracturing said frangible portion, and a substantially planar upper portion for engagement with said annular collar portion when said closure is completely threaded onto said container whereby said depending lower skirt portion cannot gradually bend outward when said closure is unthreaded from said container without causing said fracture to occur.

10. The tamper-evident closure of claim 2, wherein said depending lower skirt portion comprises a shoulder projecting outwardly from the plane of said internally threaded upper portion thereof, and wherein said inwardly projecting bead is located below said shoulder.

11. The tamper-evident closure of claim 2 including a plurality of vertical serrations on the outer surface of said internally threaded upper portion of said closure.

12. The tamper-evident closure of claim 1 or 2 including sealing means located on the inner face of said end wall for forming a seal between said closure and said container when said closure is completely threaded onto said container.

13. The tamper-evident closure of claim 12, wherein said sealing means comprises a yieldable sealing disc maintained against said inner face of said end wall.

14. The tamper-evident closure of claim 12, wherein said sealing means comprises ridge means projecting from said inner face of said end wall at a location corresponding to the location where said neck portion of said container is intended to contact said end wall when said closure is completely threaded onto said container.

15. The tamper-evident closure of claim 14 including a plurality of said ridge means.

16. The tamper-evident closure of claim 15, wherein said ridge means comprise a plurality of annular projections corresponding with the shape of said neck portion of said container.

17. The tamper-evident closure of claim 16 including three of said annular ridge means.

18. The tamper-evident closure of claim 14, wherein said ridge means have a substantially V-shaped configuration.

19. The tamper-evident closure of claim 12, wherein said sealing means comprises an annular portion of said end wall corresponding with the intended location of said neck portion of said container, said annular portion of said end wall comprising sealing membrane means having a thickness substantially less than the thickness of said end wall whereby said sealing membrane means is substantially more flexible than said end wall so as to the shape of said neck portion of said container when said closure is completely threaded onto said container.

20. The tamper-evident closure of claim 19 includng hinge means located on the inner and outer annular surfaces of said sealing membrane means so as to increase the flexibility of said sealing membrane means.

21. The tamper-evident closure of claim 20 wherein said hinge means comprises annular V-shaped grooves located on said inner face of said end wall at said inner and outer annular surfaces of said sealing membrane means.

22. The tamper-evident closure of claim 12 wherein said sealing means comprises an annular sealing ring projecting from said inner face of said end wall at a location directly adjacent to the intended location of said inner surface of said neck portion of said container when said closure is completely threaded onto said container.

23. The tamper-evident closure of claim 22 wherein said annular sealing ring includes an outwardly projecting annular bead for engagement with said inner surface of said neck portion of said container when said closure is completely threaded into said container.

24. The tamper-evident closure of claim 2 wherein said depending lower skirt portion has a substantially uniform thickness throughout its entire area intended to contact said annular collar portion.

25. The tamper-evident closure of claim 2 wherein said horizontal plane does not pass through and is not tangential to said annular collar portion.

26. The tamper-evident closure of claim 1 wherein said frangible portion is created exclusively by said circumferential groove, whereby the inner surface of said first and second intermediate side wall portions and said inner surface of said frangible portion form a substantially continuous planar inner wall surface.

27. The tamper-evident closure of claim 2 wherein said inwardly projecting bead projects inwardly to a point substantially corresponding to said plane corresponding to said inner surface of said cylindrical side wall.

* * * * *